US006812419B2

(12) United States Patent
Fukui et al.

(10) Patent No.: US 6,812,419 B2
(45) Date of Patent: Nov. 2, 2004

(54) ENABLE SWITCH

(75) Inventors: Takao Fukui, Osaka (JP); Masaki Nobuhiro, Osaka (JP); Kenji Miyauchi, Osaka (JP)

(73) Assignee: Idec Izumi Corporation, Osaka (JP)

( * ) Notice: Subject to any disclaimer, the term of this patent is extended or adjusted under 35 U.S.C. 154(b) by 0 days.

(21) Appl. No.: 10/470,937

(22) PCT Filed: Jan. 31, 2002

(86) PCT No.: PCT/JP02/00814

§ 371 (c)(1),
(2), (4) Date: Aug. 1, 2003

(87) PCT Pub. No.: WO02/061779

PCT Pub. Date: Aug. 8, 2002

(65) Prior Publication Data

US 2004/0065535 A1 Apr. 8, 2004

(30) Foreign Application Priority Data

Feb. 1, 2001 (JP) ..... 2001-25446

(51) Int. Cl.[7] ..... H01H 9/06

(52) U.S. Cl. ..... 200/332.2; 200/200; 200/553; 200/439

(58) Field of Search ..... 200/402, 405, 200/408, 416, 417, 421, 422, 431, 434, 436, 438–441, 449, 462, 467, 520, 523, 553, 533–535, 557–559, 329, 339, 341, 509, 334, 332.2

(56) References Cited

U.S. PATENT DOCUMENTS 5,428,197 A * 6/1995 McCurry et al. ..... 200/332.2
5,860,516 A * 1/1999 Geppert ..... 200/553
6,291,784 B1 * 9/2001 Neubauer et al. ..... 200/437
6,627,830 B2 * 9/2003 Fukui et al. ..... 200/434
6,680,449 B1 * 1/2004 Wang ..... 200/334

FOREIGN PATENT DOCUMENTS

| | | |
|---|---|---|
| JP | 2-1780 | 1/1990 |
| JP | 9-306281 | 11/1997 |
| JP | 10-289638 | 10/1998 |

* cited by examiner

*Primary Examiner*—Michael A. Friedhofer

(57) ABSTRACT

There are provided, together with two microswitches 20 accommodated in a cylindrical compartment 13, a manipulation member 2 which can freely swing about a pivot portion 2*a* in the directions of arrows A and B, a transmission member 3 which can freely move in reciprocating motion within a specific range between a transmitting position and a non-transmitting position located along a radial direction of an arc which is the trajectory of the swing motion of the manipulation member 2 in the directions of the arrows A and B, a contact member 4 which can freely move in reciprocating motion within a specific range between an exposed position and a retracted position in the directions of arrows E and F, a driven member 5 which can freely move in reciprocating motion in the directions of arrows G and H, and a restricting part 6 fixed at a position opposing the contact member 4. The swing motion of the manipulation member 2 in the direction of the arrow B up to a point where the manipulation member 2 goes into contact with the restricting part 6 is transmitted to the microswitches 20 via the transmission member 3 and the driven member 5, and the swing motion of the manipulation member 2 in the direction of the arrow B is not transmitted to the microswitches 20 after the contact member 4 has gone into contact with the restricting part 6. This arrangement makes it possible to achieve improved operability of an enable switch, enhanced safety with the provision of multiple contact mechanisms, and easier installation of the enable switch on a portable operator panel.

6 Claims, 6 Drawing Sheets

ENABLE SWITCH

TECHNICAL FIELD

The present invention relates to a three-position enable switch which sequentially switches a contact mechanism of its own from an OFF state to an ON state and again to the OFF state according to the position of a manipulation member in a specific direction of its operation. More particularly, the invention is concerned with an enable switch suited for a portable operator panel used for teaching an industrial robot, for example.

BACKGROUND ART

Conventionally, there exist commercially available three-position enable switches which permit a manipulation member to sequentially stop at a non-operated position, an intermediate stop position and a fully operated position as operated in a particular direction of operation with a finger of the hand, wherein a contact mechanism is set to an OFF state when the manipulation member is not operated and held at the non-operated position, the contact mechanism is set to an ON state when the manipulation member is operated up to the intermediate stop position, and the contact mechanism is again set to the OFF state when the manipulation member is further operated up to the fully operated position. The enable switches of this kind are provided on a portable operator panel used for teaching an industrial robot, for example, to ensure operator safety.

Specifically, a portable operator panel 401 connected to a control apparatus for controlling a robot is provided with enable switches 411*a,* 411*b* together with manipulation switches 409*a,* 409*b,* etc. corresponding to various motions of the robot, as shown in FIGS. 5 and 6. Operation of the individual manipulation switches 409*a,* 409*b,* etc. is enabled when the enable switches 411*a,* 411*b* are under conditions where their manipulation members have been operated to the intermediate stop position, that is, when contact mechanisms of the enable switches 411*a,* 411*b* are in the ON state. On the other hand, operation of the individual manipulation switches, etc. is disabled when the enable switches 411*a,* 411*b* are under conditions where their manipulation members are at the non-operated or fully operated position, that is, when the contact mechanisms of the enable switches 411*a,* 411*b* are in the OFF state.

With this arrangement, if the robot makes a motion unintended by the operator due to misoperation of a manipulation switch, for instance, when the operator is setting the robot into motion by manipulating the manipulation switch while operating the manipulation member of an enable switch, it is possible to set the contact mechanism of the enable switch to the OFF state and instantly stop the motion of the robot regardless of the operating state of the manipulation switch by letting the finger of the hand away from the manipulation member of the enable switch or by tightly pressing the manipulation member further from the intermediate stop position to the fully operated position.

When operating a portable operator panel, the operator normally holds it from its side with its front side on which the manipulation switches, etc. are arranged oriented frontward so that the operator can easily observe the manipulation switches, etc. with the eyes. Particularly when operating a large-sized portable operator panel, the operator holds it from both sides. To operate the robot through the portable operator panel, the operator has to operate not only the manipulation switches, etc. as stated above but also the enable switches at the same time while holding the portable operator panel.

Thus, taking into consideration the operability of the portable operator panel, the enable switches should be arranged on the portable operator panel in such a manner that its manipulation members are located in an area where fingers of the operator's hand holding the portable operator panel can be positioned face to face with the manipulation members. If the manipulation members are so arranged, the operator can press the manipulation members of the enable switches by using his or her fingers placed face to face with the manipulation members from the rear side of the panel among the fingers holding the portable operator panel from its side.

In the conventional enable switch, however, the manipulation member is provided in such a manner that it shifts generally along a straight line connecting the non-operated position to the fully operated position via the intermediate stop position, and a surface of the manipulation member with which a finger of the hand comes into contact moves in a position generally parallel to the panel surface when the manipulation member is depressed. For this reason, movement of the surface of the manipulation member with which the finger of the hand is in contact does not conform to the swing motion of the finger about its joint produced when the finger facing the manipulation member presses the manipulation member with the hand holding the portable operator panel from its side. Therefore, operability of the manipulation member is poor, and this makes it impossible in certain cases to exactly move the manipulation member in the event of an emergency stop which requires an immediate action to be taken. Also, to smoothly move the manipulation member of the conventional enable switch along the straight line over a relatively large stroke from the non-operated position to the fully operated position via the intermediate stop position, it is inevitable to make some clearance between outside surfaces of the manipulation member and a guide member in a direction perpendicular to its moving direction. For this reason, the manipulation member tends to be inclined with respect to its moving direction. As a consequence, if multiple contact mechanisms are provided to achieve enhanced safety, there might arise a case where ON/OFF states of the multiple contact mechanisms could not be switched at the same time by a single manipulation member.

Furthermore, there exist no conventional enable switches which have been designed with ease of installation on a portable operator panel in mind. Thus, it has not been possible to easily install the conventional enable switches produced as separate components, resulting in a problem that the conventional enable switches would make the process of manufacturing the portable operator panel rather complex.

Accordingly, it is an object of the invention to provide an enable switch which makes it possible to exactly move a manipulation member with improved operability in the event of an emergency stop which requires an immediate action by adapting the movement of a surface of the manipulation member in contact with a finger of the hand holding a portable operator panel from its side, for instance, to the motion of the finger facing the rear side of the panel, achieve an improvement in safety by providing multiple contact mechanisms in such a manner that the ON/OFF states of the multiple contact mechanisms can be switched at the same time by moving a single manipulation member, and simplify the process of manufacturing the portable operator panel by making it possible to easily install the enable switch produced as a separate component on the portable operator panel.

DISCLOSURE OF THE INVENTION

The present invention employs the following constructions as means for solving the aforementioned problems.

According to the present invention, an enable switch provided with a contact mechanism having a movable contact which is biased toward an OFF state switches the contact mechanism between its ON and OFF states during a period when a manipulation member moves from a non-operated position to an intermediate stop position and during a period when the manipulation member moves from the intermediate stop position to a fully operated position. The enable switch is characterized in that it is provided with a motion transmission mechanism including a first elastic member of which one end swingably supports the manipulation member in a housing and biases the manipulation member toward the non-operated position in such a manner that part of the manipulation member is exposed to the exterior, wherein the motion transmission mechanism converts a swing motion of the manipulation member from the non-operated position to the intermediate stop position into a motion of switching from the OFF state to the ON state and transmits this switching motion to the contact mechanism, converts a swing motion of the manipulation member from the intermediate stop position to the fully operated position into a motion of switching from the ON state to the OFF state and transmits this switching motion to the contact mechanism, and prohibits transmission of the swing motion of the manipulation member to the contact mechanism during a period when the manipulation member returns from the fully operated position back to the non-operated position.

In this construction, when the manipulation member is pressed against an elastic force exerted by the first elastic member, the manipulation member swings from the non-operated position to the fully operated position via the intermediate stop position. This swing motion of the manipulation member from the non-operated position to the intermediate stop position is transmitted to the contact mechanism via the motion transmission mechanism, whereby the contact mechanism is switched from the OFF state to the ON state. Also, the swing motion of the manipulation member from the intermediate stop position to the fully operated position is transmitted to the contact mechanism via the motion transmission mechanism, whereby the contact mechanism is switched from the ON state to the OFF state. When a pushing force applied to the manipulation member is released and the manipulation member begins to move from the fully operated position back to the non-operated position, transmission of the swing motion of the manipulation member to the contact mechanism by the motion transmission mechanism is prohibited until the manipulation member returns to the non-operated position via the intermediate stop position next time, and the contact mechanism is held in the OFF state by a restoring force exerted on the movable contact.

Therefore, the manipulation member swings from the non-operated position up to the fully operated position via the intermediate stop position in conformity with the motion of a finger of an operator's hand as the operator presses the manipulation member, and the contact mechanism is switched from the OFF state to the ON state during the period when the manipulation member moves from the non-operated position to the intermediate stop position. Also, the contact mechanism is switched from the ON state to the OFF state during the period when the manipulation member moves from the intermediate stop position to the fully operated position. Thereafter, the swing motion of the manipulation member is not transmitted to the contact mechanism until the manipulation member returns to the non-operated position, so that the OFF state of the contact mechanism, which was switched during the period when the manipulation member swung from the intermediate stop position to the fully operated position, is maintained until the manipulation member returns to the non-operated position next time.

Additionally, the enable switch is characterized in that the motion transmission mechanism further includes a transmission member which is supported by the manipulation member in such a manner that the transmission member can freely move between a transmitting position and a non-transmitting position located along the radial direction of an arc which is the trajectory of the swing motion of the manipulation member, a second elastic member which biases the transmission member toward its transmitting position, a contact member which is supported by the manipulation member in such a manner that the contact member can freely move between an exposed position and a retracted position located along a swing direction of the manipulation member and causes the transmission member to move from the transmitting position to the non-transmitting position during a period when the contact member moves from the exposed position to the retracted position, a third elastic member which biases the contact member toward its exposed position, a driven member which converts the swing motion of the manipulation member transmitted via the transmission member as it is located at the transmitting position into a swing motion of the movable contact, transmits this switching motion to the contact mechanism, and prohibits the transmission member from moving from the non-transmitting position to the transmitting position during the period when the manipulation member swings from the fully operated position to the non-operated position, and a restricting member which causes the contact member to move from the exposed position to the retracted position during the period when the manipulation member swings from the intermediate stop position to the fully operated position.

In this construction, the motion transmission mechanism for transmitting the swing motion of the manipulation member to the contact member includes the transmission member which is biased toward the transmitting position under conditions where the transmission member is supported in such a manner that it can freely move relative to the manipulation member between the transmitting position and the non-transmitting position located along the radial direction of the arc which is the trajectory of the swing motion of the manipulation member, the contact member which is biased toward the exposed position and causes the transmission member to move from the transmitting position to the non-transmitting position during the period when the contact member moves from the exposed position to the retracted position under conditions where the contact member is supported in such a manner that it can freely move relative to the manipulation member between the exposed position and the retracted position located along the swing direction of the manipulation member, and the driven member which converts the swing motion of the manipulation member transmitted via the transmission member as it is located at the transmitting position into the switching motion of the movable contact, transmits this switching motion to the contact mechanism, and prohibits the transmission member from moving from the non-transmitting position to the transmitting position during the period when the manipulation member swings from the fully operated position to the non-operated position.

Therefore, the transmission member is located at the transmitting position during the period when the manipulation member swings from non-operated position to the intermediate stop position, and the swing motion of the manipulation member is transmitted to the contact mechanism in the form of the switching motion of the movable contact via the transmission member and the driven member, whereby the contact mechanism is switched from the OFF state to the ON state. While moving from the exposed position to the retracted position, the contact member causes the transmission member to move up to the non-transmitting position during the period when the manipulation member swings from the intermediate stop position to the fully operated position as the contact member is in contact with the restricting member. Consequently, the swing motion of the manipulation member becomes nontransmittible to the contact mechanism, the movable contact of the contact mechanism returns to the state which existed before the commencement of the swing motion of the manipulation member due to the restoring force, and the contact mechanism is switched from the OFF state to the ON state. Since the driven member prohibits the transmission member from moving to the transmitting position during the period when the manipulation member swings from the fully operated position to the non-operated position, no swing motion of the manipulation member is transmitted to the contact mechanism and the contact mechanism is held in the OFF state to which the contact mechanism was switched when manipulation member reached the fully operated position.

Additionally, the enable switch is characterized in that only such part of the manipulation member located in the radial direction of its swing motion is exposed outward from the housing that a manipulating torque exerted on the manipulation member about its point of support is larger than the moment exerted by the first to third elastic members.

In this construction, the manipulating torque exerted by the finger of the operator's hand on the part of the manipulation member exposed outward from the housing is always larger than the moment of the elastic force biasing the contact member toward its exposed position. Therefore, the manipulation member moves up to the fully operated position against the elastic force acting on the contact member as a result of operation of the manipulation member with the finger of the operator's hand.

Additionally, the enable switch is characterized in that multiple contact mechanisms are arranged side by side in a direction perpendicular to the radial direction of the arc which is the trajectory of the swing motion of the manipulation member.

In this construction, the multiple contact mechanisms are arranged side by side in the direction perpendicular to the radial direction of the arc which is the trajectory of the swing motion of the manipulation member. The manipulation member smoothly swings about the point of support located at its one end with certainty without being inclined with respect to the swing direction. Therefore, the manipulation member does not produce during its swing motion any inclination with respect to the direction perpendicular to the radial direction of the arc which is the trajectory of the swing motion of the manipulation member, and the movable contacts of the multiple contact mechanisms joined to this portion always function in the same condition.

Additionally, the enable switch is characterized in that a cylindrical compartment is formed projectingly from a flat surface of the housing on its side opposite to the side where the manipulation member is exposed to the exterior, and the contact mechanism is accommodated in this compartment.

In this construction, the contact mechanism is accommodated in the compartment projecting from the flat surface of the housing on its side opposite to the side where the manipulation member is exposed to the exterior. Therefore, the contact mechanism is disposed on the inside of an apparatus, such as a portable operator panel, on which the enable switch should be installed if the cylindrical compartment is fitted in a hole formed in the apparatus.

BEST MODES FOR CARRYING OUT THE INVENTION

Figure 1B:
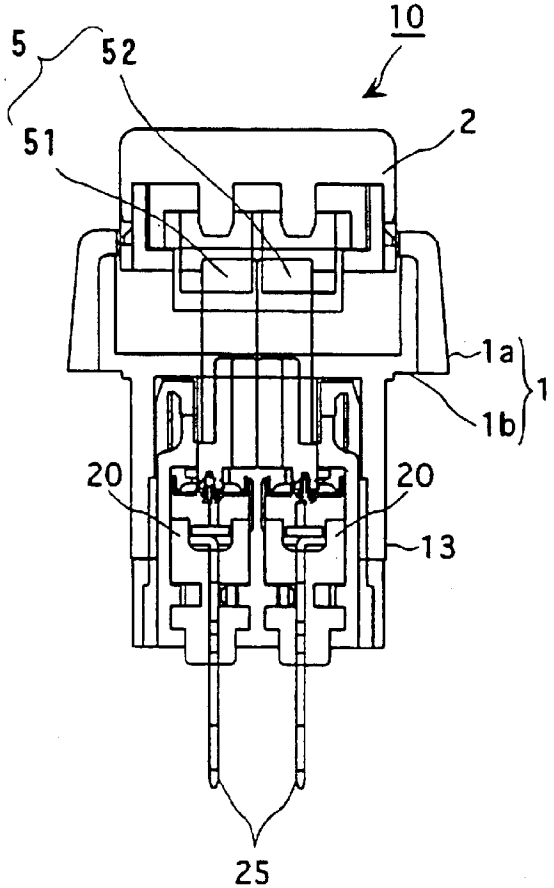
FIG. 1 is a cross-sectional side view and a cross-sectional front view showing the construction of an enable switch according to an embodiment of the invention.
Figure 1A:
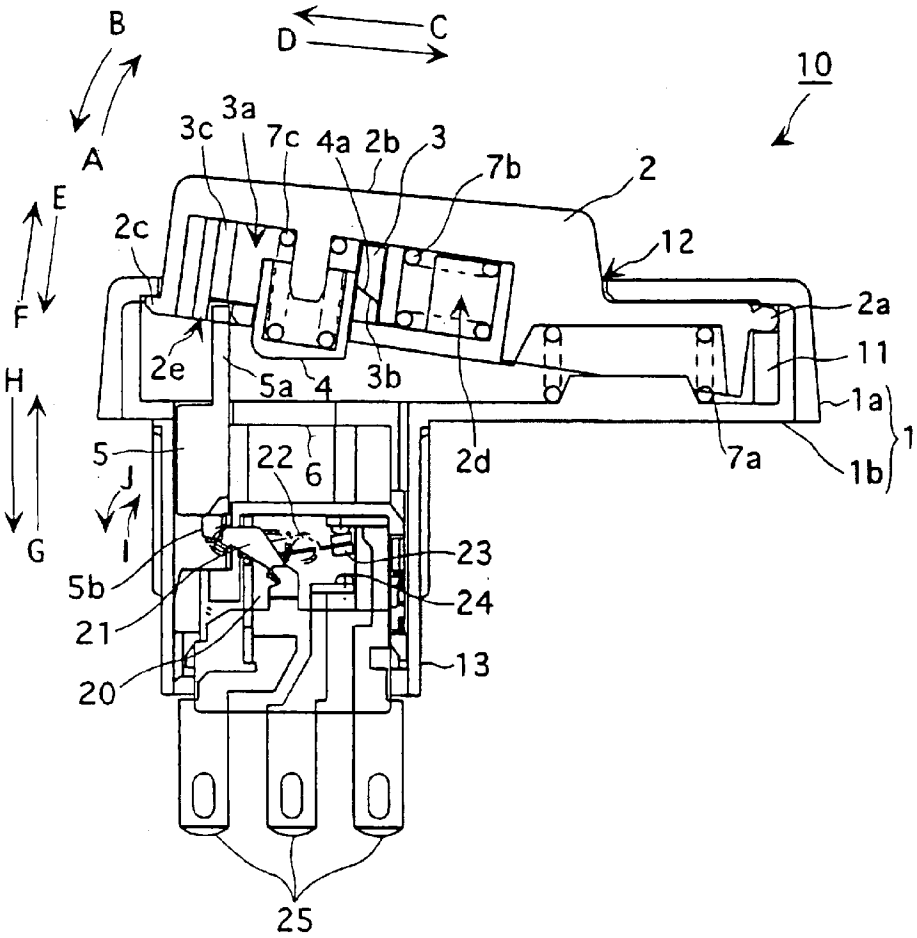

FIGS. 1(A) and 1(B) are a cross-sectional side view and a cross-sectional front view, respectively, showing the construction of an enable switch according to an embodiment of the invention. As shown in FIG. 1(A), the enable switch 10 is constructed of a housing 1 including a manipulating case 1*a* and a mounting case 1*b* in which a manipulation member 2, a transmission member 3, a contact member 4, a driven member 5 and coil springs 7*a*, 7*b*, 7*c* are accommodated together with two microswitches 20. The transmission member 3, the contact member 4, the driven member 5 and the coil springs 7*a*, 7*b*, 7*c* together constitute a motion transmission mechanism of this invention. The microswitches 20 are accommodated in a hollow cylindrical compartment 13 formed projectingly outward from the manipulating case 1*a*. The interior of this compartment 13 opens toward the mounting case 1*b*. There is formed an externally threaded portion on the outer peripheral surface of the compartment 13.

A pivot portion 2*a* of the manipulation member 2 formed projectingly from its one end is sandwiched between a pivot support portion 11 formed on the inside of the mounting case 1*b* and an inside surface of the manipulating case 1*a* in such a manner that the manipulation member 2 can freely swing about the pivot portion 2*a* in the directions of arrows A and B. A manipulating portion 2*b* of the manipulation member 2 is exposed to the exterior through an opening 12 formed in the manipulating case 1*a*. The manipulation member 2 is biased in the direction of the arrow A by an elastic force exerted by the coil spring 7*a* which is a first elastic member of the invention. There is formed a contact portion 2*c* at the other end of the manipulation member 2. Movement of the manipulation member 2 in the direction of the arrow A is restricted when the contact portion 2*c* goes into contact with the inner peripheral surface of the opening 12. In this manipulation member 2, there is formed a cavity 2*d* of which part is exposed to a surface of the manipulation member 2 opposite to the manipulating portion 2*b*.

The transmission member 3 is made freely movable in reciprocating motion within a specific range between a transmitting position and a non-transmitting position located along a radial direction (the directions of arrows C and D) of the swing motion of the manipulation member 2 inside its cavity 2*d* in the directions of the arrows A and B. The transmission member 3 has a hollow 3*a* opening to two surfaces of the manipulation member 2 intersecting its swing direction. The transmission member 3 is biased in the direction of the arrow C pointing toward the transmitting position by an elastic force exerted by the coil spring 7*b* which is a second elastic member of the invention. Under conditions where the transmission member 3 is located at the transmitting position shown in FIG. 1(A), a far end portion 3*c* of the transmission member 3 is exposed to the exterior through an opening 2*e* of the cavity 2*d*. There is formed at part of the transmission member 3 a slant surface 3*b* which is inclined relative its moving direction parallel to the directions of the arrows C and D.

The contact member 4 is made freely movable in reciprocating motion within a specific range between an exposed position and a retracted position in the directions of arrows E and F within the cavity 2*d* of the manipulation member 2, and inside the hollow 3*a* of the transmission member 3. The contact member 4 is biased in the direction of the arrow E pointing toward the exposed position by an elastic force exerted by the coil spring 7*c* which is a third elastic member of the invention. There is formed at part of the contact member 4 a slant surface 4*a*. This slant surface 4*a* is in contact with the slant surface 3*b* formed on the transmission member 3.

The driven member 5 is made freely movable in reciprocating motion in the directions of arrows G and H inside the housing 1 and within the compartment 13. One end portion 5*a* of the driven member 5 enters the cavity 2*d* of the manipulation member 2 through its opening 2*e* and goes into contact in the direction of the arrow G with the far end portion 3*c* of the transmission member 3 which is located at the transmitting position. The other end portions 5*b* of the driven member 5 are joined to actuators 21 of the two microswitches 20 within the compartment 13 in the same conditions.

More specifically, the driven member 5 is divided into a left-hand element 51 and a right-hand element 52, and the aforementioned other end portions 5*b* of the left-hand element 51 and the right-hand element 52 are joined to one end of the actuator 21 of each microswitch 20 as shown in FIG. 1(B).

As will be later discussed, the enable switch 10 is constructed in such a manner that operation of the manipulation member 2 is transmitted to the microswitches 20 via the driven member 5. Under conditions where both of the two microswitches 20 are normally operational, the left-hand element 51 and the right-hand element 52 of the driven member 5 individually actuate the two microswitches 20 at the same time. In contrast, when one of the two microswitches 20 fails due to contact welding, for instance, operation of the manipulation member 2 is transmitted to the other normally operating microswitch 20 via the left-hand element 51 or the right-hand element 52 whichever joined to the normally operating microswitch 20.

Also, even when a failure occurs in the working of one of the left-hand element 51 and the right-hand element 52 under conditions where the two microswitches 20 are set to an ON state, operation of the manipulation member 2 is transmitted via the remaining normally operating left-hand element 51 or right-hand element 52, whichever applicable, to the corresponding microswitch 20.

Therefore, even when a failure occurs in one of the two microswitches 20, or in the left-hand element 51 or the right-hand element 52 of the driven member 5, it is possible to normally actuate one of the microswitches 20 by operating the manipulation member 2.

There is formed a restricting part 6 in the mounting case 1*b* at its position opposing the contact member 4 in an opening connected to the compartment 13. This restricting part 6 corresponds to a restricting member which constitutes part of the motion transmission mechanism of the invention.

The two microswitches 20 correspond to contact mechanisms of this invention and are arranged side by side in a direction perpendicular to the radial direction of the arc which is the trajectory of the swing motion of the manipulation member 2 within the compartment 13. The individual microswitches 20 are shaped symmetrically about an axis of symmetry passing through their central position in the direction of their arrangement and have essentially the identical configuration. In each microswitch 20, the actuator 21 of which one end is joined to the other end portion 5*b* of the driven member 5 is made freely swingable in the directions of arrows I and J about the other end of the actuator 21, and is biased in the direction of the arrow I by an elastic force exerted by a reset spring 22. The actuator 21 constitutes a drive mechanism for driving a movable contact 23. When the actuator 21 moves in the direction of the arrow J, the movable contact 23 moves in a direction of going into contact with a stationary contact 24. When the actuator 21 reaches a dead point located in the direction of the arrow I, the microswitch 20 opens, whereby the microswitch 20 is switched from the ON state to an OFF state. Joint terminals 25 of each microswitch 20 are exposed outward from the compartment 13.

FIG. 1 shows a condition in which an operator does not press the manipulation member 2 of the enable switch 10. In this condition, the microswitches 20 are in the OFF state, the manipulation member 2 is located at its non-operated position, the transmission member 3 is located at its transmitting position, and the contact member 4 is located at its exposed position. As shown in FIG. 1, the movable contacts 23 of the microswitches 20 are separated from the respective stationary contacts 24 and, therefore, the microswitches 20 are in the OFF state under conditions where the individual members are located at their non-operated positions.

Figure 2:
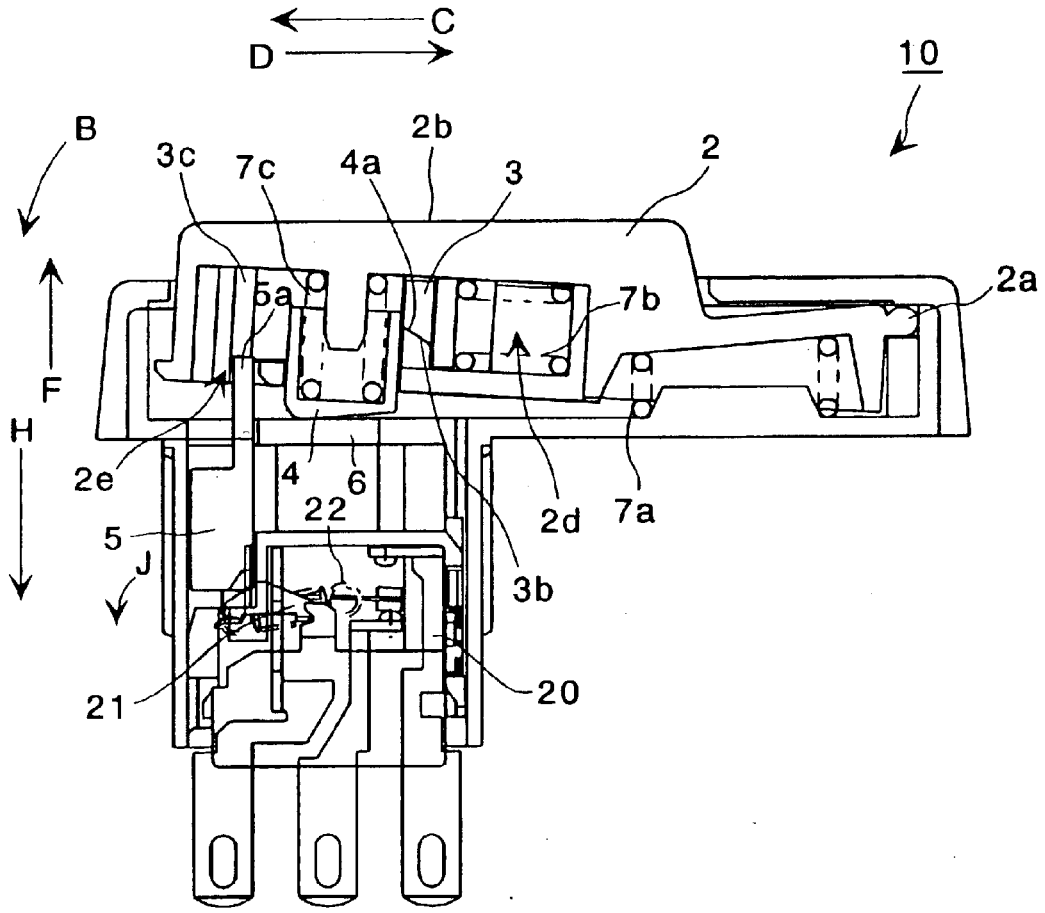
FIG. 2 is a diagram showing an operating state of the enable switch during a period when a manipulation member is located at an intermediate stop position.
Figure 3:
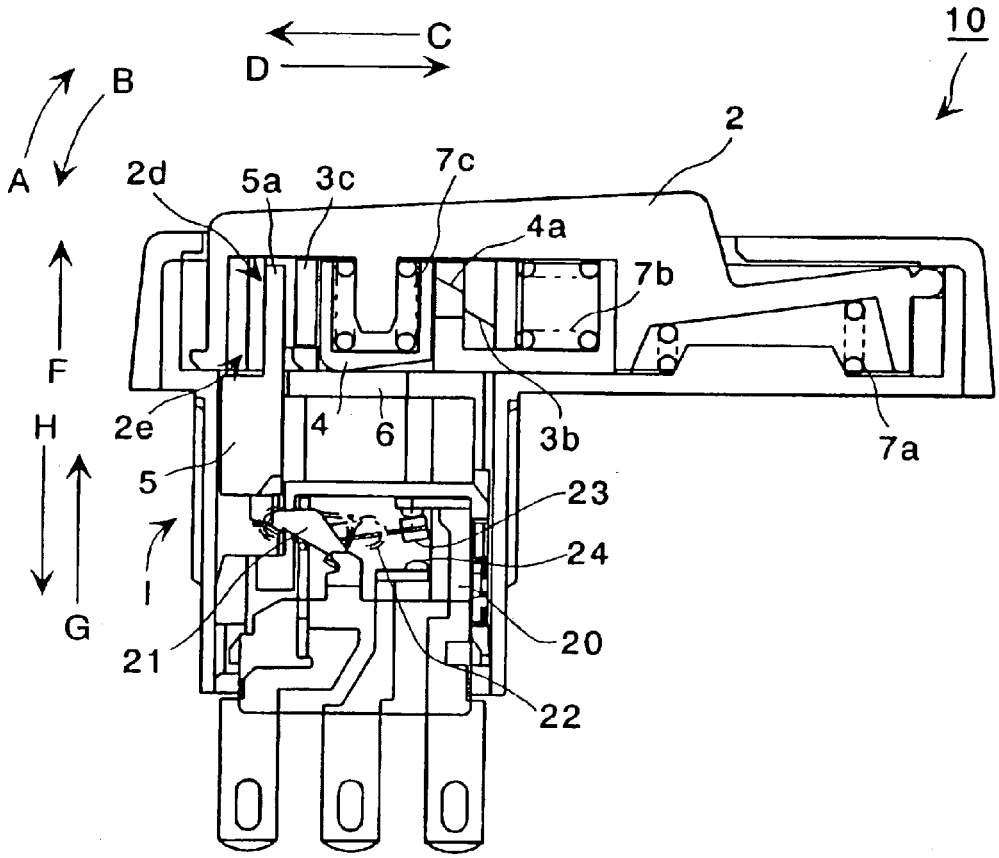
FIG. 3 is a diagram showing an operating state of the enable switch during a period when the manipulation member is located at a fully operated position.

FIGS. 2 and 3 are diagrams showing operating conditions of the enable switch, wherein FIG. 2 shows a state in which the manipulation member is located at an intermediate stop position, and FIG. 3 shows a state in which the manipulation member is located at a fully operated position. When the manipulating portion 2*b* of the manipulation member 2 provided in the enable switch 10 is pressed from the state shown in FIG. 1 against the elastic force exerted by the coil spring 7*a*, the manipulation member 2 swings about the pivot portion 2*a* in the direction of the arrow B together with the transmission member 3, the contact member 4 and the coil springs 7*b* and 7*c* which are held in the cavity 2*d*.

Since the far end portion 3*c* of the transmission member 3 goes into contact with the aforementioned one end portion 5*a* of the driven member 5 in the opening 2*e* of the cavity 2*d* in the manipulation member 2 at this time, the swing motion of the manipulation member 2 in the direction of the arrow B is transmitted via the transmission member 3 to the driven member 5 in the form of a moving force acting in the direction of the arrow H. Consequently, the driven member 5 moves in the direction of the arrow H against the elastic force exerted by the reset springs 22 of the microswitches 20 and causes the actuators 21 to swing in the direction of the arrow J. Therefore, when the manipulation member 2 is pushed, the elastic force of the reset springs 22 acts in addition to the elastic force of the coil spring 7*a* as a resisting force acting on the manipulation member 2.

As the manipulation member 2 swings in the direction of the arrow B, the contact member 4 also shifts in the direction of the arrow B. When this movement of the contact member 4 in the direction of the arrow B is restricted as it goes into contact with the restricting part 6, the elastic forces exerted by the coil springs 7*b* and 7*c* provide an additional resisting force acting against further depression of the manipulation member 2 that causes it to further swing in the direction of the arrow B beyond the restricted position.

More specifically, in order to cause the manipulation member 2 to further swing in the direction of the arrow B beyond the position where the contact member 4 is in contact with the restricting part 6, it is necessary to move the contact member 4 in the direction of the arrow F relative to the manipulation member 2 at first. The elastic force of the coil spring 7*c* acts as a resisting force against this movement of the contact member 4. In addition, it is necessary to shift the transmission member 3 having the slant surface 3*b* which is in contact with the slant surface 4*a* of the contact member 4 in the direction of the arrow D relative to the manipulation member 2, and the elastic force of the coil spring 7*b* biasing the transmission member 3 in the direction of the arrow C also acts as a resisting force.

Therefore, if the operator maintains the same pushing force that has so far been applied to the manipulation member 2 in a condition where the contact member 4 is in contact with the restricting part 6, the swing motion of the manipulation member 2, the transmission member 3 and the contact member 4 in the direction of the arrow B and the movement of the driven member 5 in the direction of the arrow H are interrupted and the manipulation member 2, etc. are halted at the intermediate stop position in the same condition as shown in FIG. 2.

Under conditions where the individual members are located at the intermediate stop position as shown in FIG. 2, the actuators 21 of the microswitches 20 reach their dead points and the movable contacts 23 go into contact with the respective stationary contacts 24, whereby the microswitches 20 are switched from the OFF state to the ON state.

If the operator exerts a further pushing force on the manipulation member 2 against the elastic forces of the coil springs 7*b* and 7*c* from the condition in which the individual members are located at the intermediate stop position shown FIG. 2, the manipulation member 2 swings in the direction of the arrow B together with the manipulation member 2 and the transmission member 3. On the other hand, the contact member 4 moves in the direction of the arrow F relative to the manipulation member 2 because the movement of the contact member 4 in the direction of the arrow B is restricted as it is in contact with the restricting part 6. The transmission member 3 is held in such a manner that it can move only in the directions of the arrows C and D perpendicular to the direction of the arrow F within the cavity 2*d* of the manipulation member 2 at this time, and the transmission member 3 has the slant surface 3*b* which goes into contact with the slant surface 4*a* of the contact member 4. For this reason, the movement of the contact member 4 in the direction of the arrow F is converted by the slant surfaces 4*a*, 3*b* into a moving force oriented in the direction of the arrow D. This moving force is transmitted to the transmission member 3, causing it to shift in the direction of the arrow D within the cavity 2*d* of the manipulation member 2.

If the operator continues to press the manipulation member 2 and the transmission member 3 reaches its non-operated position located at the position of one end of the cavity 2*d* of the manipulation member 2, the far end portion 3*c* of the transmission member 3 becomes no longer located at the opening 2*e* of the cavity 2*d*. Thus, the aforementioned one end portion 5*a* of the driven member 5 becomes no longer opposed to the far end portion 3*c* of the transmission member 3 and the transmission member 3 and the driven member 5 are disengaged from each other at this point.

As a result, the moving force which has so far acted on the driven member 5 in the direction of the arrow H no longer acts, so that the driven member 5 moves in the direction of the arrow G due to the elastic force of the reset springs 22 and the one end portion of the driven member 5 is accommodated in the cavity 2*d* of the manipulation member 2. Also, the contact member 4 is accommodated in the cavity 3*d* of the transmission member 3, where the contact member 4 is set to the retracted position. In this condition, the manipulation member 2 is located at the fully operated position shown in FIG. 3. As a consequence, the actuators 21 swing in the direction of the arrow I and the movable contacts 23 are separated from the stationary contacts 24, whereby the microswitches 20 are switched from the ON state to the OFF state.

When the manipulation member 2 is no longer pressed from the condition where it is located at the fully operated position, the manipulation member 2 swings in the direction of the arrow A together with the transmission member 3 due to the elastic forces of the coil springs 7*a* and 7*c* while the contact member 4 moves in the direction of the arrow E relative to the manipulation member 2 and the transmission member 3. As a result, the manipulation member 2 returns to the state shown in FIG. 1 in which the manipulation member 2 is located at the non-operated position via the state shown in FIG. 2 in which the manipulation member 2 is located at the intermediate stop position, and the contact member 4 is set to the exposed position at a point in time when the manipulation member 2 reaches the intermediate stop position.

It is to be noted, however, that although the transmission member 3 is biased in the direction of the arrow C by the elastic force of the coil spring 7*b* since the point in time when the transmission member 3 has moved to its non-operated position, the movement of the transmission member 3 in the direction of the arrow C is restricted as the far end portion 3*c* of the transmission member 3 comes into contact with the aforementioned one end portion 5*a* of the driven member 5 which is accommodated in the cavity 2*d* of the manipulation member 2. Thus, the transmission member 3 can not return to the transmitting position until the manipulation member 2 reaches its non-operated position. Therefore, the microswitches 20 are never switched from the OFF state to the ON state during a period when the manipulation member 2 returns from the fully operated position to the non-operated position.

Figure 4:
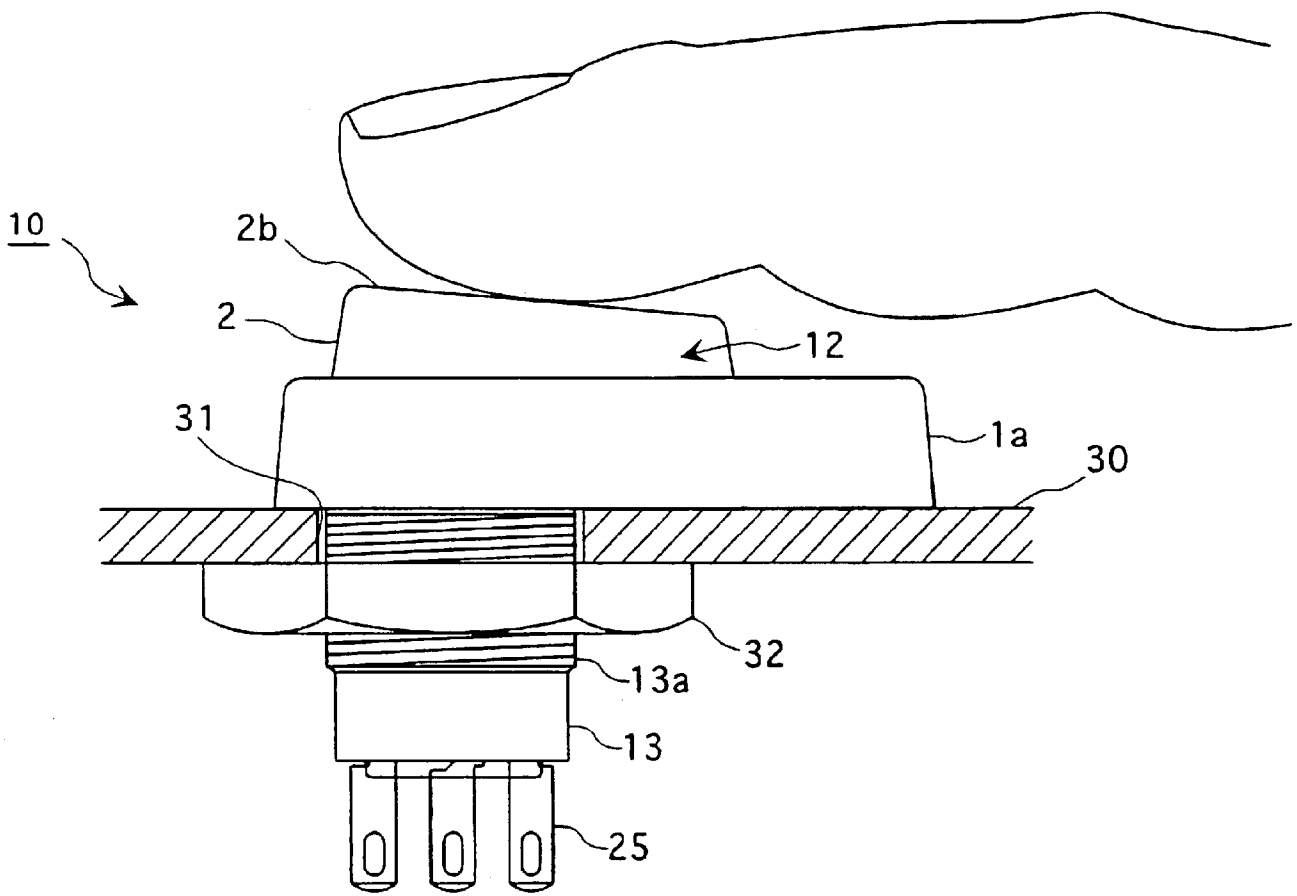
FIG. 4 is a diagram illustrating how the aforementioned enable switch is mounted and used on a portable operator panel.
Figure 5:
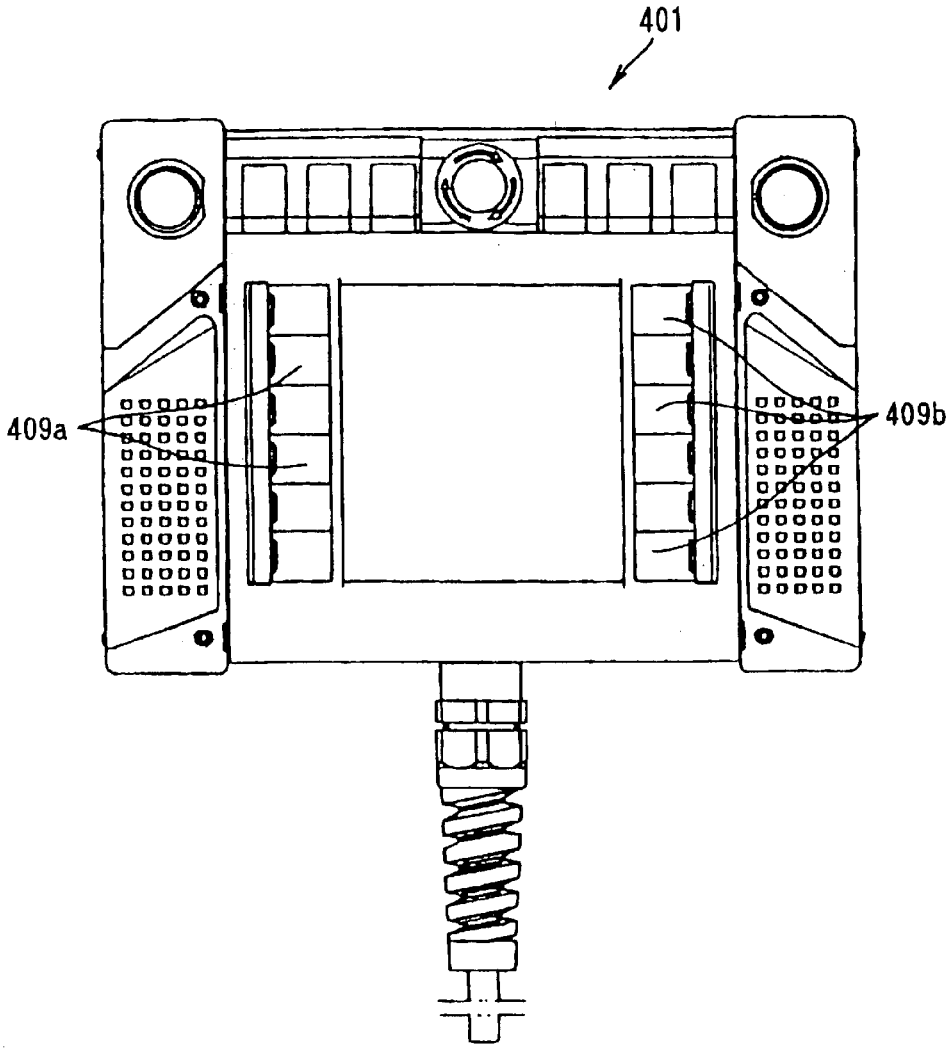
FIG. 5 is a plan view of a portable operator panel in which generally available enable switches including those of the embodiment of the present invention may be used.
Figure 6:
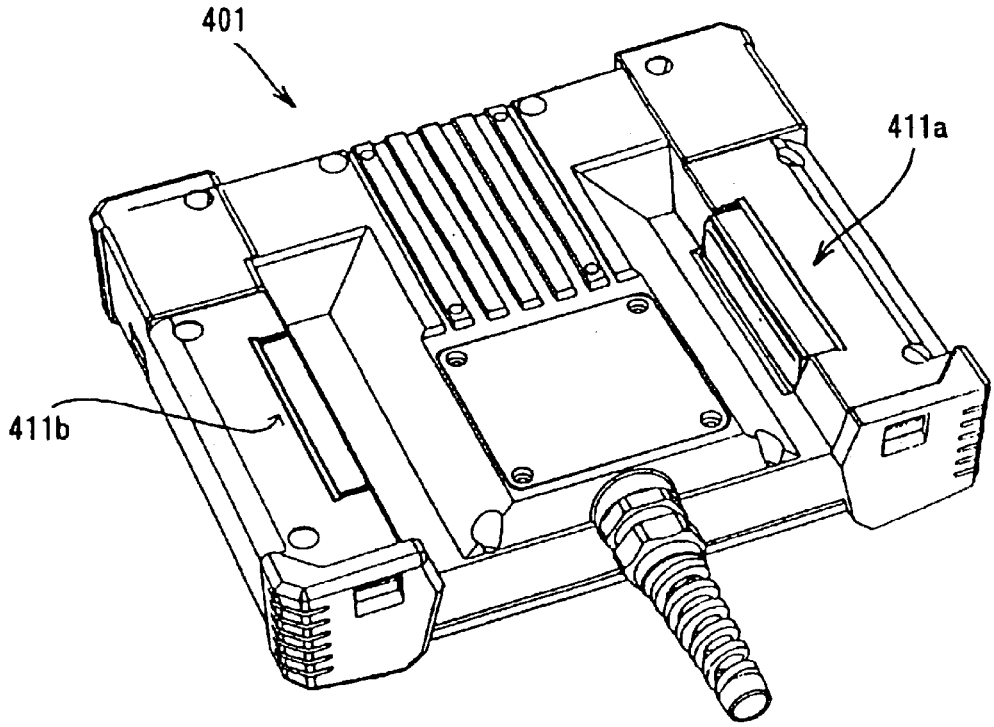
FIG. 6 is a perspective diagram as viewed from the rear side showing how conventional enable switches are mounted on a portable operator panel.

FIG. 4 is a diagram illustrating how the aforementioned enable switch is mounted and operated on a portable operator panel. When installing the enable switch 10 of the embodiment of the invention on a portable operator panel 30 used for teaching a robot, for instance, with the enable switch 10 exposed to the rear side of the portable operator panel 30, the compartment 13 is first inserted from the rear side into a round hole 31 formed in the rear side of the portable operator panel 30 at a mounting position of the enable switch 10, the inside diameter of the round hole 31 being approximately equal to the outside diameter of the compartment 13.

Next, a fastening screw 32 is tightened on the externally threaded portion 13*a* formed on the outer peripheral surface of the compartment 13 which is exposed to the interior of the portable operator panel 30, so that a rear panel of the portable operator panel 30 is sandwiched between the fastening screw 32 and a side surface of the enable switch 10 on its mounting side. Subsequently, the joint terminals 25 of the microswitches 20 exposed to the outside of the compartment 13 on the interior of the portable operator panel 30 are connected to unillustrated electric circuitry provided in the portable operator panel 30.

The cylindrical compartment 13 is formed projectingly from a flat surface on the mounting side of the enable switch 10 and the microswitches 20 are accommodated in the compartment 13 in the aforementioned fashion. Therefore, the enable switch 10 produced as a separate component can be installed extremely easily on the portable operator panel 30 by simply forming the round hole 31 at a specific position on the rear side of the portable operator panel 30.

Here, the shape of the compartment 13 is not necessarily limited to the circular cylinder. As an alternative, the compartment 13 may be formed into a rectangular-based cylindrical shape on condition that it can accommodate the microswitches 20 inside. In this case, a rectangular hole that matches the shape of the compartment 13 is formed in the portable operator panel 30.

A mounting surface (the mounting case 1*b*) of the enable switch 10 opposed to the rear side of the portable operator panel 30 is formed into a shape that matches the rear side of the portable operator panel 30. Specifically, since the rear side of the portable operator panel 30 is formed into a flat plane shape in the present example, the mounting surface of the enable switch 10 is also formed into a flat plane shape. Thus, the mounting surface of the enable switch 10 comes in close contact with the rear side of the portable operator panel 30 and the round hole 31 is completely covered by the mounting surface of the enable switch 10 when the compartment 13 is fitted into the round hole 31 formed in the rear side of the portable operator panel 30. It is therefore possible to easily give the portable operator panel 30 a waterproofing capability by covering the enable switch 10 installed on the rear side of the portable operator panel 30 from the outside with a flexible resin, for instance.

If the enable switch 10 of the embodiment of the invention is installed on the rear side of the portable operator panel 30 in the manner stated above, the manipulation member 2 of the enable switch 10 swings about the pivot portion 2*a* provided at one end when pressed by any of the fingers of the operator's hand holding the portable operator panel 30 from its side. On the other hand, the finger of the operator's hand holding the portable operator panel 30 from its side swings about a finger joint when pressing the rear side of the portable operator panel 30. Thus, the movement of the manipulation member 2 mounted on the rear side of the portable operator panel 30 conforms to the motion of the finger of the operator's hand that presses the manipulation member 2, so that the manipulation member 2 can be easily pressed by the finger of the operator's hand from the non-operated position up to the fully operated position via the intermediate stop position. As a consequence, it is possible to easily and smoothly perform the task of teaching a robot, for example, by operating manipulation switches or else provided on the portable operator panel 30 while keeping the manipulation member 2 of the enable switch 10 at the intermediate stop position at the same time and instantly stop a subject of operation, such as a robot, by quickly moving the manipulation member 2, which is currently located at the intermediate stop position, to the non-operated position or the fully operated position when the subject of operation makes an abnormal action unintended by the operator.

Only such part of the manipulating portion 2*b* of the manipulation member 2 located in the radial direction of its swing motion is exposed to the exterior through the opening 12 in the manipulating case 1*a* that a manipulating torque exerted on the manipulation member 2 about its point of support when an ordinary operator presses the manipulation member 2 with a finger of the hand is larger than the moment exerted by the coil springs 7*a*, 7*b*, 7*c*. It is therefore possible to reliably apply such a pushing force to the manipulation member 2 by pressing it that is necessary for moving the manipulation member 2 from the non-operated position to the fully operated position via the intermediate stop position while switching the microswitches 20 from the OFF state to the ON state against the elastic forces of the coil springs 7*a*, 7*b*, 7*c*. Thus, the microswitches 20 can be switched to the OFF state in a reliable manner when the operator tightly presses the manipulation member 2 in the event of an emergency stop which requires an immediate action. This makes it possible to stop the subject of operation with high reliability when the subject of operation currently operated via the portable operator panel 30 makes an abnormal action, thereby ensuring the safety of the operator.

Furthermore, because the enable switch 10 accommodates the two microswitches 20 which are arranged in a direction parallel to the pivot portion 2*a*about which the manipulation member 2 swings, the ON/OFF states of the two microswitches 20 can always be switched simultaneously as a result of the swing motion of the manipulation member 2 about its pivot portion 2*a*. Accordingly, even if one of the two microswitches 20 fails, the portable operator panel 30 can output a control signal (teaching signal) corresponding to the state of operation of the manipulation member 2 by the operator with precision based on the ON/OFF states of the other microswitch 20. Thus, the provision of the multiple contact mechanisms serves to further enhance the safety of the operator.

In addition, since the driven member 5 prohibits the transmission member 3 from moving from the non-transmitting position to the transmitting position during a period until the manipulation member 2 which has departed from the intermediate stop position returns to the non-operated position via the fully operated position, no swing motion of the manipulation member 2 is transmitted to the microswitches 20 via the transmission member 3 and the driven member 5 during this period. Thus, the microswitches 20 do not switch from the OFF state to the ON state, causing the subject of operation to take action, during a period after the operator has caused the manipulation member 2 to swing from the intermediate stop position to the fully operated position by increasing the pushing force exerted on it for causing an emergency stop of the subject of operation manipulated via the portable operator panel 30 until the manipulation member 2 swings from the fully operated position to the non-operated position when the pushing force exerted on it is released. It is therefore possible to maintain the subject of operation in the state of emergency stop with certainty during the aforementioned period so that the safety is further enhanced.

Even when the driven member 5 is formed as a one-piece component and one of the two microswitches 20 fails, it is possible to transmit the act of pressing the manipulation member 2 to the other normally operating microswitch 20 via the one-piece driven member 5 and cause the manipulation member 2 to return to its original position with the aid of the elastic force exerted by the reset spring 22 of the normally operating microswitch 20 via the one-piece driven member 5.

When the manipulation member is pressed against an elastic force exerted by the first elastic member, the manipulation member swings from the non-operated position to the fully operated position via the intermediate stop position, and this swing motion of the manipulation member from the non-operated position to the intermediate stop position is transmitted to the contact mechanism via the motion transmission mechanism, whereby the contact mechanism is switched from the OFF state to the ON state. Also, the swing motion of the manipulation member from the intermediate stop position to the fully operated position is transmitted to the contact mechanism via the motion transmission mechanism, whereby the contact mechanism is switched from the ON state to the OFF state. Thus, the present invention makes it possible to cause the manipulation member to swing from the non-operated position up to the fully operated position via the intermediate stop position in conformity with the motion of a finger of an operator's hand when the operator presses the manipulation member. Accordingly, the invention can improve operability in switching the contact mechanism to the ON state by moving the manipulation member from the non-operated position to the intermediate stop position and in switching the contact mechanism to the OFF state by moving the manipulation member from the intermediate stop position to the non-operated position or the fully operated position.

After the manipulation member has begun to move from the fully operated position back to the non-operated position, transmission of the swing motion of the manipulation member to the contact mechanism by the motion transmission mechanism is prohibited until the manipulation member returns to the non-operated position next time, and the contact mechanism is held in the OFF state by a restoring force exerted on the movable contact, and the contact mechanism is maintained in the OFF state by a restoring force exerted on the movable contact. Therefore, after the manipulation member has begun to move from the fully operated position to the non-operated position, it is possible to ensure that the swing motion of the manipulation member is not transmitted to the contact mechanism until the manipulation member returns to the non-operated position next time via the intermediate stop position. Further, it is possible to reliably prevent the contact mechanism, which was once switched to the OFF state when the pushing force applied to the manipulation member was released, from switching to the ON state and maintain an apparatus to be operated in a state of emergency stop with certainty.

Furthermore, as the motion transmission mechanism for transmitting the swing motion of the manipulation member to the contact mechanism includes the transmission member, the contact member and the driven member which individually perform specific operations, it is possible to switch the contact mechanism from the OFF state to the ON state with certainty as a result of the swing motion of the manipulation member from the non-operated position to the intermediate stop position and to switch the contact mechanism from the ON state to the OFF state with certainty as a result of the swing motion of the manipulation member from the intermediate stop position to the fully operated position by way of the transmission member, the contact member and the driven member. Also, it is possible to ensure that the contact mechanism is not switched from the OFF state to the ON state as a result of the swing motion of the manipulation member from the fully operated position to the non-operated position, and maintain the OFF state of the contact mechanism which was switched to the OFF state during a period when the manipulation member swung from the intermediate stop position to the fully operated position with certainty.

In addition, a manipulating torque exerted by a finger of the operator's hand on part of the manipulation member exposed outward from the housing is made always larger than the moment of the elastic force biasing the contact member toward its exposed position. Therefore, it is possible to cause the manipulation member to move up to the fully operated position with certainty against the elastic force acting on the contact member as a result of operation of the manipulation member with the finger of the operator's hand.

Furthermore, multiple contact mechanisms are arranged side by side in the direction perpendicular to the radial direction of the arc which is the trajectory of the swing motion of the manipulation member, so that it is possible to cause the individual movable contacts of the multiple contact mechanisms to always function in the same condition via the manipulation member which smoothly swings about the point of support located at one end with certainty without being inclined with respect to the swing direction. Also, even when one of the contact mechanisms fails, it is possible to provide enhanced safety by causing the remaining contact mechanism to output a contact signal desired by the operator with high precision.

Moreover, the driven member is divided in the direction perpendicular to the radial direction of the arc which is the trajectory of the swing motion of the manipulation member into the same number of elements as the number of the contact mechanisms arranged side by side. In this construction, even when one of multiple microswitches fails or a failure occurs in the working of part of the driven member, it is possible to cause the normal microswitch to function with certainty by operating the manipulation member via a normally working part of the driven member.

In addition, the contact mechanisms are accommodated in the cylindrical compartment projecting from a flat surface of the housing on its side opposite to the side where the manipulation member is exposed to the exterior. In this construction, the enable switch can be easily installed by fitting the compartment in a hole formed in an apparatus, such as a portable operator panel.

INDUSTRIAL APPLICABILITY

This invention can be used for improving the operability of an enable switch, enhancing the safety with the provision of multiple contact mechanisms, and facilitating installation of the enable switch on a portable operator panel.

What is claimed is:

1. An enable switch provided with a contact mechanism having a movable contact which is biased toward an OFF state, in which said enable switch switches the contact mechanism between the ON and OFF states during a period when a manipulation member moves from a non-operated position to an intermediate stop position and during a period when the manipulation member moves from the intermediate stop position to a fully operated position, said enable switch being characterized by comprising:

a motion transmission mechanism including a first elastic member of which one end swingably supports the manipulation member in a housing and biases the manipulation member toward the non-operated position in such a manner that part of the manipulation member is exposed to the exterior;

wherein the motion transmission mechanism converts a swing motion of the manipulation member from the non-operated position to the intermediate stop position into a motion of switching from the OFF state to the ON state and transmits the switching motion to the contact mechanism, converts the swing motion of the manipulation member from the intermediate stop position to the fully operated position into the motion of switching from the ON state to the OFF state and transmits the switching motion to the contact mechanism, and prohibits transmission of the swing motion of the manipulation member to the contact mechanism during a period when the manipulation member returns from the fully operated position back to the non-operated position.

2. The enable switch according to claim 1, wherein said enable switch is characterized in that said motion transmission mechanism further includes:

a transmission member which is supported by the manipulation member in such a manner that the transmission member can freely move between a transmitting position and a non-transmitting position located along a radial direction of an arc which is a trajectory of the swing motion of the manipulation member;

a second elastic member which biases the transmission member toward the transmitting position;

a contact member which is supported by the manipulation member in such a manner that the contact member can freely move between an exposed position and a retracted position located along a swing direction of the manipulation member and causes the transmission member to move from the transmitting position to the non-transmitting position during a period when the contact member moves from the exposed position to the retracted position;

a third elastic member which biases the contact member toward the exposed position;

a driven member which converts the swing motion of the manipulation member transmitted via the transmission member as it is located at the transmitting position into a switching motion of the movable contact, transmits the switching motion to the contact mechanism, and prohibits the transmission member from moving from the non-transmitting position to the transmitting position during the period when the manipulation member swings from the fully operated position to the non-operated position; and a restricting member which causes the contact member to move from the exposed position to the retracted position during the period when the manipulation member swings from the intermediate stop position to the fully operated position.

3. The enable switch according to claim 1, wherein said enable switch is characterized in that only such part of said manipulation member located in the radial direction of the swing motion is exposed outward from the housing that a manipulating torque exerted on the manipulation member about the point of support is larger than a moment exerted by the first to third elastic members.

4. The enable switch according to claim 1, wherein said enable switch is characterized in that multiple contact mechanisms are arranged side by side in a direction perpendicular to a radial direction of an arc which is a trajectory of the swing motion of the manipulation member.

5. The enable switch according to claim 4, wherein said enable switch is characterized in that said driven member is divided in a direction perpendicular to the radial direction of the arc which is the trajectory of the swing motion of the manipulation member into the same number of elements as the number of the contact mechanisms arranged side by side.

6. The enable switch according to claim 1, wherein said enable switch is characterized in that a cylindrical compartment is formed projectingly from a flat surface of the housing on a side opposite to a side where the manipulation member is exposed to the exterior, and said contact mechanism is accommodated in the compartment.

* * * * *